US009978230B2

(12) United States Patent
Schaeffer

(10) Patent No.: US 9,978,230 B2
(45) Date of Patent: May 22, 2018

(54) BREAK-IN ALARM ASSEMBLY

(71) Applicant: Stephanie Schaeffer, Fairview, OR (US)

(72) Inventor: Stephanie Schaeffer, Fairview, OR (US)

( * ) Notice: Subject to any disclaimer, the term of this patent is extended or adjusted under 35 U.S.C. 154(b) by 0 days. days.

(21) Appl. No.: 15/225,973

(22) Filed: Aug. 2, 2016

(65) Prior Publication Data

US 2018/0040213 A1 Feb. 8, 2018

(51) Int. Cl.
*G08B 13/08* (2006.01)

(52) U.S. Cl.
CPC ..... *G08B 13/08* (2013.01)

(58) Field of Classification Search
CPC ..... G08B 13/08
USPC ..... 340/545.1
See application file for complete search history.

(56) References Cited

U.S. PATENT DOCUMENTS

| | | | | |
|---|---|---|---|---|
| 4,193,067 | A * | 3/1980 | Hawkins | G08B 13/08 116/86 |
| 4,553,134 | A | 11/1985 | Holt | |
| 4,837,557 | A | 6/1989 | Striebel | |
| 4,888,578 | A | 12/1989 | Conemac | |
| 5,872,514 | A | 2/1999 | Neas | |
| 6,075,440 | A | 6/2000 | Carroll | |
| 6,388,572 | B1 | 5/2002 | Salter | |
| 6,778,086 | B2 * | 8/2004 | Morrone | E05B 65/0888 116/86 |
| 6,943,686 | B2 * | 9/2005 | Allen | G08B 13/08 340/546 |
| 2007/0075859 | A1 * | 4/2007 | Garavuso | G08B 13/08 340/547 |

FOREIGN PATENT DOCUMENTS

WO WO2004053808 6/2004

* cited by examiner

*Primary Examiner* — Qutbuddin Ghulamali

(57) ABSTRACT

A break-in alarm assembly for emitting an audible alarm when a window is opened includes a rod unit that may be positioned to extend between a lower pane of a window and a frame of the window. An alarm unit is coupled to the rod unit. The alarm unit emits an audible alarm when the lower pane is opened.

7 Claims, 3 Drawing Sheets

BREAK-IN ALARM ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to alarm devices and more particularly pertains to a new alarm device for emitting an audible alarm when a window is opened.

BRIEF SUMMARY OF THE INVENTION

An embodiment of the disclosure meets the needs presented above by generally comprising a rod unit that may be positioned to extend between a lower pane of a window and a frame of the window. An alarm unit is coupled to the rod unit. The alarm unit emits an audible alarm when the lower pane is opened.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
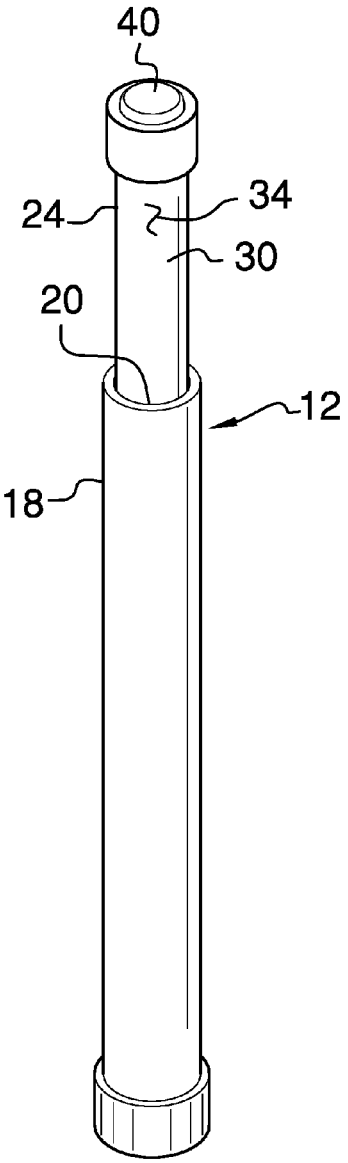
FIG. 1 is a perspective view of a break-in alarm assembly according to an embodiment of the disclosure.
Figure 2:
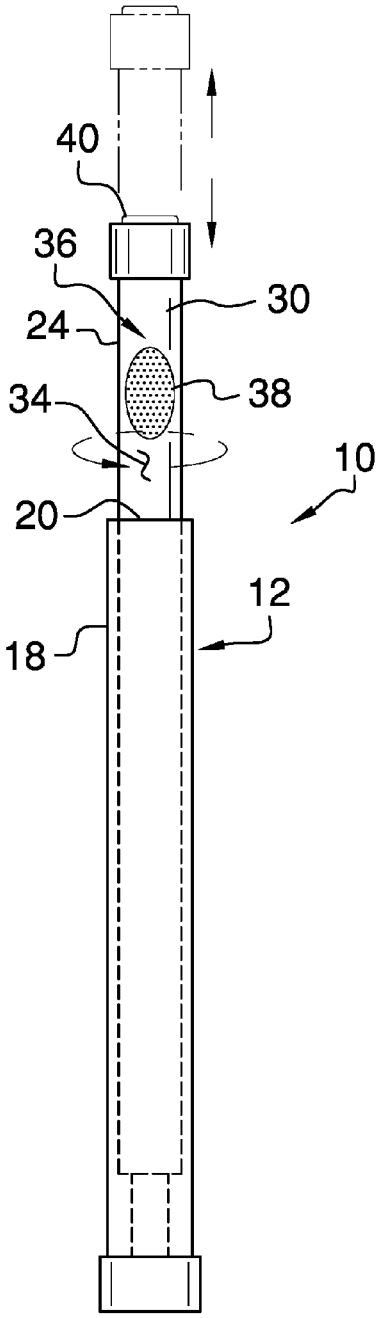
FIG. 2 is a front view of an embodiment of the disclosure.
Figure 3:
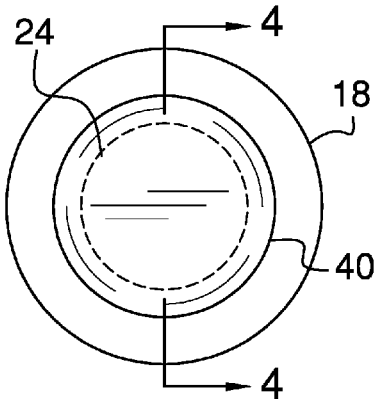
FIG. 3 is a top phantom view of an embodiment of the disclosure.
Figure 4:
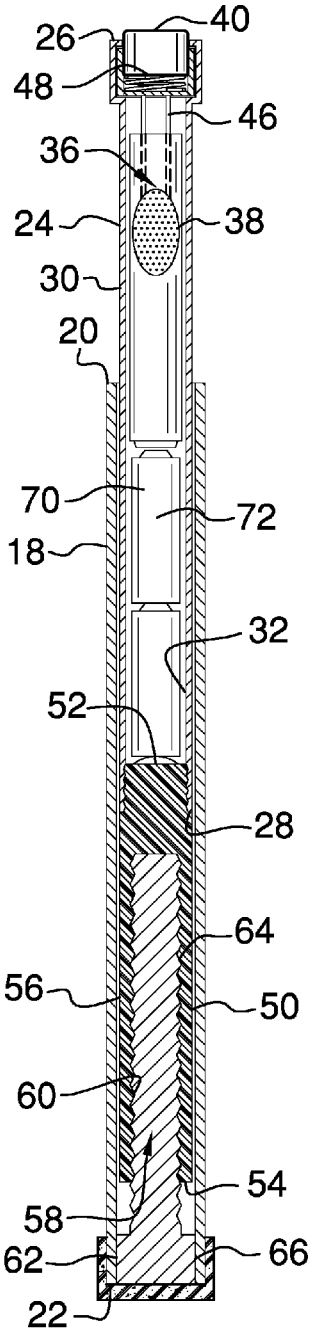
FIG. 4 is a cross sectional view taken along line 4-4 of FIG. 3 of an embodiment of the disclosure.
Figure 5:
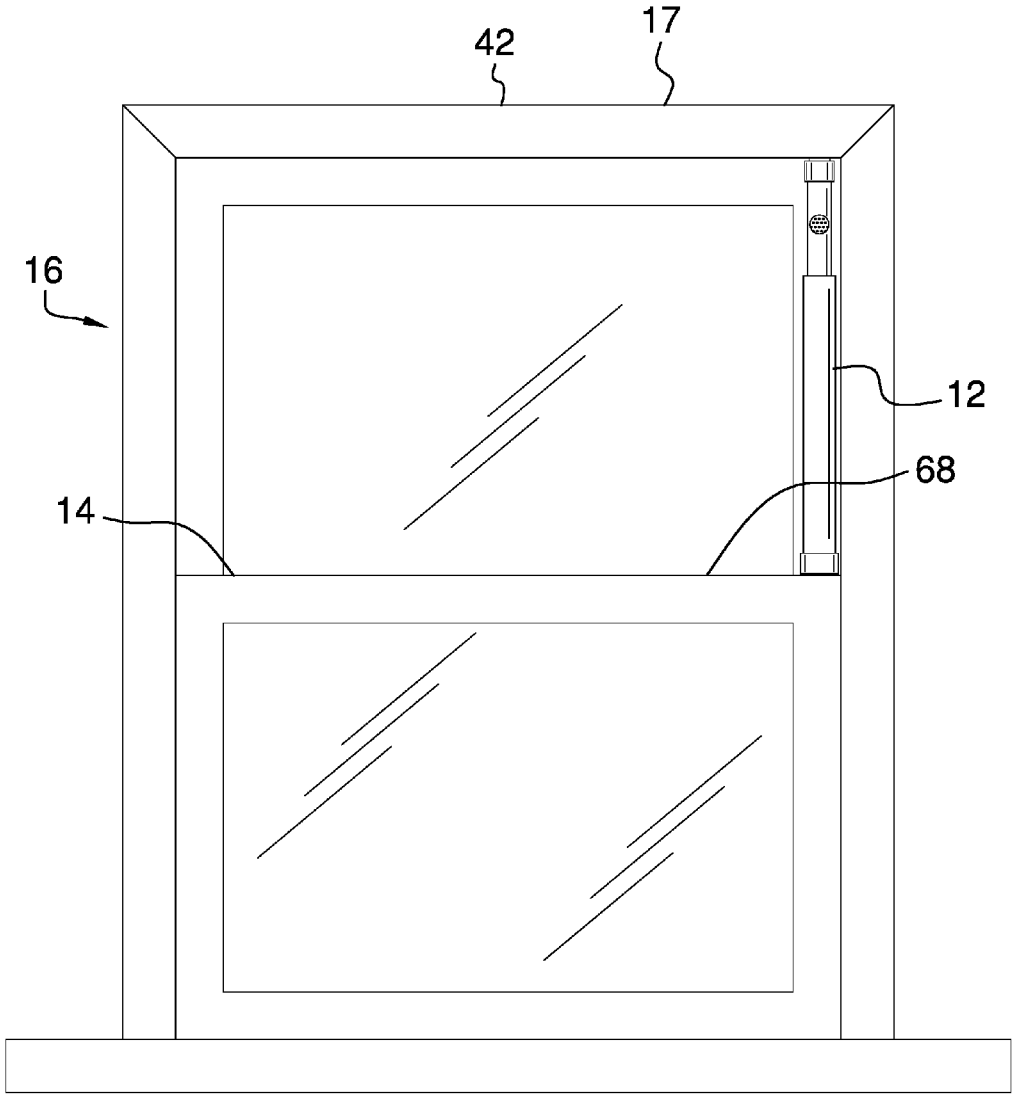
FIG. 5 is a perspective in-use view of an embodiment of the disclosure.

With reference now to the drawings, and in particular to FIGS. 1 through 5 thereof, a new alarm device embodying the principles and concepts of an embodiment of the disclosure and generally designated by the reference numeral 10 will be described.

As best illustrated in FIGS. 1 through 5, the break-in alarm assembly 10 generally comprises a rod unit 12. The rod unit 12 may be positioned to extend between a lower pane 14 of a window 16 and a frame 17 of the window 16. The window 16 may be a window 16 in a building or the like. The window 16 may be a single hung window 16 or the like.

The rod unit 12 comprises a sleeve 18. The sleeve 18 has a first end 20 and a second end 22. Each of the first end 20 and the second end 22 are open. The sleeve 18 is positioned to extend upwardly from the lower pane 14.

A tube 24 is provided that has an upper end 26, a lower end 28 and an outer wall 30 extending therebetween. The outer wall 30 has an inner surface 32 and an outer surface 34. Each of the upper end 26 and the lower end 28 are open. The tube 24 is substantially hollow.

The tube 24 is slidably inserted into the first end 20 of the sleeve 18. Moreover, the tube 24 extends outwardly from the first end 20 of the sleeve 18. Thus, the tube 24 extends between the sleeve 18 and the frame 17 of the window 16. The inner surface 32 is threaded adjacent to the lower end 28.

An alarm unit 36 is provided. The alarm unit 36 is coupled to the rod unit 12. The alarm unit 36 emits an audible alarm when the lower pane 14 is opened. The alarm unit 36 comprises a speaker 38 that is coupled to the outer surface 34 of the tube 24. Thus, the speaker 38 may emit an audible alarm. The speaker 38 may be an electronic alarm speaker 38 or the like.

A button 40 is positioned in the upper end 26 of the tube 24. The button 40 frictionally engages a top member 42 of the frame 17 of the window 16. The button 40 is electrically coupled to the speaker 38. The button 40 turns the speaker 38 on when the button 40 is compressed against the top member 42 of the frame 17 of the window 16. Thus, the speaker 38 may emit the audible alarm when the lower pane 14 is opened.

A contact 46 is electrically coupled to the button 40. The contact 46 is positioned within the tube 24. The contact 46 is electrically coupled between the button 40 and the speaker 38. A biasing member 48 is positioned within the tube 24. The biasing member 48 biases the button 40 outwardly from the upper end 26. The biasing member 48 may be a spring or the like.

A plug 50 is provided that has a primary end 52, a secondary end 54 an exterior surface 56 extending therebetween. The exterior surface 56 is threaded adjacent to the primary end 52. The exterior surface 56 threadably engages the inner surface 32 of the tube 24. Thus, the plug 50 is positioned within the sleeve 18. The secondary end 54 has a well 58 extending toward the primary end 52. The well 58 has a bounding surface 60 and the bounding surface 60 is threaded. The well 58 is directed toward the second end 22 of the sleeve 18.

A screw 62 is provided. The screw 62 has a stem 64 and a head 66. The stem 64 is threaded and the stem 64 is selectively inserted into the second end 22 of the sleeve 18. The stem 64 threadably engages the bounding surface 60 of the well 58 in the plug 50. The screw 62 adjusts a length of the rod unit 12 thereby facilitating the rod unit 12 to accommodate a variety of window 16 sizes. The head 66 engages a top side 68 of the lower pane 14.

A power supply 70 is positioned within the tube 24. The power supply 70 is electrically coupled to the contact 46 when the power supply 70 is positioned in the tube 24. The primary end 52 of the plug 50 compresses the power supply 70 against the contact 46 when the plug 50 is threadably coupled to the tube 24. The power supply 70 comprises at least one battery 72.

In use, the rod unit 12 is positioned to extend between the top side 68 of the lower pane 14 and the top member 42 of the frame 17. The tube 62 is twisted to move along the stem 64 of the screw 62. Thus, the button 40 is positioned adjacent to the top member 42 of the frame 17. The button 40 is compressed against the top member 42 of the frame 17 when the lower pane 14 is opened. Thus, the speaker 38 is turned on and the speaker 38 emits the audible alarm. Thus, a user is alerted that the window 16 has been opened. A plurality of rod units 12 may each be positioned in an associated one of a plurality of windows 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A break-in alarm assembly comprising:

a rod unit being configured to be positioned to extend between a lower pane of a window and a frame of the window wherein said rod is positioned to be compressed between a lower pane of the window and a frame of the window when the window is opened, said rod unit including a sleeve having a first end and a second end, each of said first end and said second end of said sleeve being open, and a tube having an upper end, a lower end and an outer wall extending between said upper end and said lower end of said tube, said outer wall having an inner surface and an outer surface, each of said upper end and said lower end of said tube being open, said tube being substantially hollow, said tube being slidably inserted into said first end of said sleeve having said tube extending outwardly from said first end, said outer surface of said upper end being flared outwardly wherein said upper end of said tube has a diameter greater then a diameter of a medial portion of said tube extending from said upper end to said first end of said sleeve, and a combined length of said tube and said sleeve being adjustable, said combined length of said tube and said sleeve being adjusted by rotation of said sleeve and said tube relative to each other; and an alarm unit being coupled to said rod unit, said alarm unit emitting an audible alarm when said rod is compressed, said alarm unit including a speaker being coupled to said tube, said audible alarm being emitted from said speaker, and a button being positioned in said upper end of said tube such that said button extends from said upper end of said tube, said button being operationally coupled to said speaker such that compression of said button into said upper end of said tube activates said speaker to emit said audible alarm, a peripheral edge of a top surface of said button being laterally inset from an outer perimeter surface of said tube, a peripheral wall of said button having a constant diameter extending away from said top surface wherein said peripheral wall is perpendicular to said top surface.

2. The assembly according to claim 1, further comprising a contact being coupled to said button, said contact being positioned within said tube, said contact being urged into contact with a power supply within said tube when said button is compressed into said upper end of said tube, said contact being electrically coupled to said speaker wherein said speaker emits said audible alarm when said contact contacts said power supply.

3. The assembly according to claim 2, further comprising said power supply comprising at least one battery.

4. The assembly according to claim 1, further comprising a biasing member being positioned within said tube, said biasing member biasing said button outwardly from said upper end.

5. The assembly according to claim 1, further comprising a plug having a primary end, a secondary end an exterior surface extending therebetween, said exterior surface being threaded adjacent to said primary end, said exterior surface threadably engaging said inner surface of said tube having said plug being positioned within said sleeve, said secondary end having a well extending toward said primary end, said well having a bounding surface, said bounding surface being threaded, said well being directed toward said second end of said sleeve.

6. The assembly according to claim 5, further comprising a screw having a stem and a head, said stem being threaded, said stem being selectively inserted into said second end of said sleeve, said stem threadably engaging said bounding surface of said well in said plug such that said head is spaced a selected distance from said second end of said sleeve wherein said screw is configured to adjust said combined length of said sleeve and said tube.

7. A break-in alarm assembly being configured to be placed in a window thereby facilitating said alarm assembly to detect when the window is forcibly opened, said assembly comprising:

a rod unit being configured to be positioned between a lower pane of a window and a frame of the window, said rod unit comprising:

a sleeve having a first end and a second end, each of said first end and said second end being open, said sleeve being configured to be extend upwardly from the lower pane, a tube having an upper end, a lower end and an outer wall extending therebetween, said outer wall having an inner surface and an outer surface, each of said upper end and said lower end being open, said tube being substantially hollow, said tube being slidably inserted into said first end of said sleeve having said tube extending outwardly from said first end wherein said tube is configured to extend between said sleeve and the frame of the window, said outer surface of said upper end being flared outwardly wherein said upper end of said tube has a diameter greater then a diameter of a medial portion of said tube extending from said upper end to said first end of said sleeve, and a combined length of said tube and said sleeve being adjustable, said combined length of said tube and said sleeve being adjusted by rotation of said sleeve and said tube relative to each other; and an alarm unit being coupled to said rod unit, said alarm unit being configured to emit an audible alarm when the lower pane is opened, said alarm unit comprising:

a speaker being coupled to said outer surface of said tube wherein said speaker is configured to emit an audible alarm, a button being positioned in said upper end of said tube wherein said button is configured to frictionally engage the frame of the window, said button being electrically coupled to said speaker, said button turning said speaker on when said button is compressed against the frame of the window wherein said speaker is configured to emit the audible alarm when the lower pane is opened, a peripheral edge of a top surface of said button being laterally inset from an outer perimeter surface of said tube, a peripheral wall of said button having a constant diameter extending away from said top surface wherein said peripheral wall is perpendicular to said top surface, a contact being electrically coupled to said button, said contact being positioned within said tube, said contact being electrically coupled between said button and said speaker, a biasing member being positioned within said tube, said biasing member biasing said button outwardly from said upper end, a plug having a primary end, a secondary end an exterior surface extending therebetween, said exterior surface being threaded adjacent to said primary end, said exterior surface threadably engaging said inner surface of said tube having said plug being positioned within said sleeve, said secondary end having a well extending toward said primary end, said well having a bounding surface, said bounding surface being threaded, said well being directed toward said second end of said sleeve, a screw having a stem and a head, said stem being threaded, said stem being selectively inserted into said second end of said sleeve, said stem threadably engaging said bounding surface of said well in said plug such that said head is spaced a selected distance from said second end of said sleeve wherein said screw is configured to adjust a length of said rod unit thereby facilitating said rod unit to accommodate a variety of window sizes, and a power supply being positioned within said tube, said power supply being electrically coupled to said contact when said power supply is positioned in said tube, said primary end of said plug compressing said power supply against said contact when said plug is threadably coupled to said tube, said power supply comprising at least one battery.

* * * * *